United States Patent [19]

Larson

[11] 4,143,743

[45] Mar. 13, 1979

[54] EAVES LADDER GRIP

[76] Inventor: Dale W. Larson, 74 Sparta Ave., Eveleth, Minn. 55734

[21] Appl. No.: 912,247

[22] Filed: Jun. 5, 1978

[51] Int. Cl.[2] ..... E06C 5/36; E06C 7/48

[52] U.S. Cl. ..... 182/206; 182/107

[58] Field of Search ..... 182/206, 107, 108, 93, 182/129, 214; 248/210, 211, 238

[56] References Cited

U.S. PATENT DOCUMENTS

| | | | |
|---|---|---|---|
| 3,603,431 | 9/1971 | Nameche | 182/206 |
| 3,712,419 | 1/1973 | O'Hara | 182/107 |
| 3,713,510 | 1/1973 | O'Dell | 182/107 |
| 3,896,900 | 7/1975 | Hunter | 182/107 |
| 3,910,380 | 10/1975 | Nameche | 182/206 |
| 4,018,301 | 4/1977 | Nameche | 182/206 |

*Primary Examiner*—Reinaldo P. Machado
*Attorney, Agent, or Firm*—Clarence A. O'Brien; Harvey B. Jacobson

[57] ABSTRACT

A bracket including a clamp for removable clamped engagement with a ladder is provided for support from an upstanding inclined ladder and includes a rigid support arm projecting horizontally outwardly from the clamp and the side of the ladder facing in the direction toward which theladder is inclined. The outer end of the arm includes a mount supported therefrom for angular displacement about an axis extending transversely of the support arm and an elongated clamp arm is supported from the mount for oscillation therewith relative to the arm. The clamp arm is disposed at generally right angles relative to the axis of oscillation of the mount and is swingable with the mount in a plane generally paralleling the support arm. The clamp arm includes one end portion which may be lengthwise advanced and retracted relative to the mount. The mount and support arm include coacting structure for releasably retaining the mount in first and second predetermined angularly displaced positions including a first position in which the clamp arm extends in a direction disposed at generally right angle relative to the support arm and a second position with the clamp arm is inclined generally 45 degrees relative to the support arm toward the upper end of the ladder, respectively.

11 Claims, 5 Drawing Figures

EAVES LADDER GRIP

BACKGROUND OF THE INVENTION

Various forms of attaching structures have been heretofore provided for support from the upper end of a ladder and designed to be utilized in securing the upper end of the ladder to an object against which the upper end of the ladder is inclined. However, most of these previously known structures are relatively complex in nature and include spring biased or other clamping structures or hooks for clamping or hooked engagement with the structure against which the associated ladder is engaged. Such clamp structures and hooks are, in many instances, specifically designed for engaging a particular portion of the structure against which the upper end of the associated ladder rests and include those which are specifically designed to engage extended roofing panels, gutters and other building portions which may be found along upper peripheral portions of buildings.

While these previously known clamp structures and hooks are operative in specific environmental uses of ladders, they are not particularly well adapted for various different environmental uses. Accordingly, a need exists for an attachment for a ladder which may be utilized to rigidly engage and support a ladder relative to various different structures against which the upper end of the ladder may be leaned and with the attachment constructed in a manner whereby the structures engaged thereby are rigidly clamped between the attachment and the ladder so as to render the attachment more readily adaptable for use in anchoring the upper end of the associated ladder against movement relative to various differrent types of structures, even against the application of abnormal pressures tending to shift the ladder reelative to the associated structure.

Various forms of ladder attachments including some of the general structural and operational features of the instant invention are disclosed in U.S. Pat. Nos. 866,078, 1,374,060, 3,603,431 and 3,712,419.

BRIEF DESCRIPTION OF THE INVENTION

The attachment of the instant invention includes mounting structure whereby it may be used singly or in pairs and may be supported from either one or both side rails of a ladder. The attachment includes an arm extending outwardly therefrom which is adapted to be generally horizontally disposed when in use and to project from the side of the adjacent ladder to be leaned against an elevated structure. The outer end of the arm rotatably supports a support member therefrom for oscillation about a horizontal axis extending transversely of the arm and a clamp screw is readily supported from the support member for lengthwise extension and retraction of one end of the clamp screw relative to the support member. The clamp screw extends at substantially right angles relative to the aforementioned axis and is swingable, upon oscillation of the support member relative to the arm, in a plane generally paralleling the arm. The support member is oscillatable between first and second positions relative to the arm with the clamp screw disposed in an upwardly projecting vertical position when the support member is in the first position of oscillation thereof and the clamp screw inclined approximately 45 degrees relative to the arm toward the inner end thereof when the support member is in the second position thereof. Further, the support member and arm include coacting structure for releasably retaining the support member in each of its first and second positions of oscillation. Also, the mounting structure comprises a clamp for slidably engaging an associated ladder side rail and for clampingly engaging the ladder in order to releasably retain the mounting structure in adjusted position along the associated ladder side rail.

The main object of this invention is to provide an attachment for a ladder to be utilized in securing the upper end of the ladder to an elevated structure against which the upper end of the ladder is leaned, in both specialized ladder applications as well as normal ladder applications.

Another object of this invention is to provide a ladder attachment constructed in a manner whereby it will be operative to rigidly clampingly support the upper end of the associated ladder from substantially all types of elevated structures against which the ladder may be leaned and with the ladder secured in position against shifting relative to the structure, even against the application of abnormal pressures tending to shift the ladder relative to the associated structure.

Yet another object of this invention is to provide a ladder attachment in accordance with the preceding objects and constructed in a manner whereby it may be adjusted longitudinally of the associated ladder.

A further object of this invention is to provide a ladder attachment constructed in a manner whereby it may be utilized in conjunction with various types of ladders and readily transferred from one ladder to another.

A final object of this invention to be specifically enumerated herein is to provide a ladder attachment in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
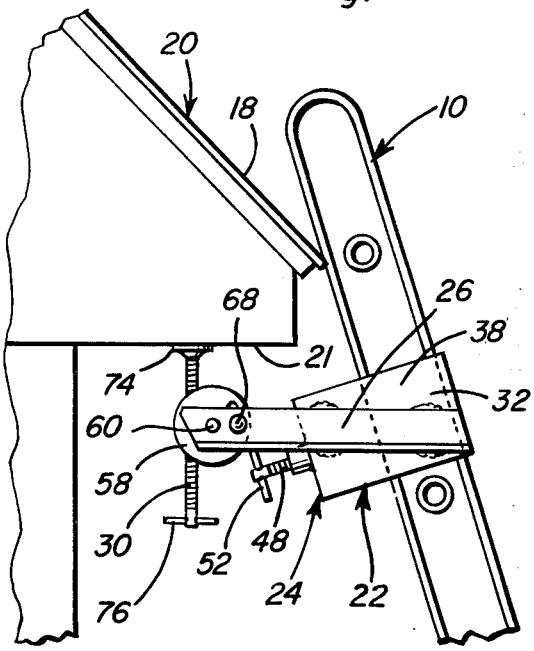
FIG. 1 is a fragmentary, side elevational view of the upper end portion of a ladder leaned against one marginal portion of a building roof and with the attachment of the instant invention operatively associated with the roof marginal portion for clampingly supporting the upper end of the ladder therefrom.

Referring now more specifically to FIGS. 1, 2, 4 and 5 of the drawings, there may be seen a conventional form of ladder referred to in general by the reference numeral 10, including a pair of opposite side longitudinal side rails 12 and 14 interconnected by means of transverse rungs 16 extending between the side rails 12 and 14 at points spaced longitudinally therealong. The upper end of the ladder 10 is leaned against the lower marginal portion 18 of a building roof structure referred to in general by the reference numeral 20 and it may be seen from FIG. 1 of the drawings that the roof structure 20 includes a horizontally outwardly projecting closed eave portion 21.

The attachment or bracket of the instant invention is referred to in general by the reference numeral 22 and includes a clamp assembly referred to in general by the reference numeral 24, a support arm 26 projecting outwardly from the clamp assembly 24, a mount 28 oscillatably supported from the outer end of the support arm 26 and a clamp screw 30 threadedly supported from the mount 28.

The clamp assembly 24 includes a channel body 32 consisting of a pair of spaced opposing flanges 34 and 36 rigidly interconnected by means of a bight portion 38 extending and secured therebetween. The marginal edge of the flange 36 remote from the bight portion 38 includes a right angularly directed flange or lip 40 extending toward the flange 34 and a flange 42 is disposed within the channel body 32 between and generally paralleling the flanges 34 and 36 and the marginal edge of the flange 42 remote from the bight portion 38 includes a right angular flange or lip 44 projecting towards the flange 36.

The flange 34 includes a central opening formed therethrough about which a threaded sleeve 46 is anchored to the side of the flange 34 remote from the flange 36 and a clamp screw 48 is threaded through the sleeve 46 and has it end adjacent the flange 42 rotatably anchored to the latter as at 50. The end of the clamp screw 48 remote from the flange 42 is provided with a transverse handle 52 to facilitate manual turning of the clamp screw 48.

The side of the bight portion 38 remote from the flanges 34, 36 and 42 has one end of the support arm 26 secured thereto by welding as at 56 and the other end of the support arm 26 projects outwardly from the clamp assembly 24. A disk-shaped mount 58 is pivotally supported from the outer free end of the support arm 26 by means of a pivot fastener 60 and the mount 58 includes angularly spaced apertures 62 selectively registrable with an aperture 64 formed in the support arm 26 and having a sleeve 66 registered therewith. The sleeve 66 is secured to the support arm 26 on the side thereof remote from the mount 58 and a locking pin 68 may be passed through the sleeve 66, the aperture or bore 64 and one of the bores or apertures 62 and secured in position by means of a removable fastener 70 in order to releasably locking secure the mount 58 in one of two relatively angularly displaced position relative to the support arm 26.

The side of the mount 58 remote from the arm 26 includes an internally threaded sleeve 72 supported therefrom and the clamp screw 30 is threadedly engaged through the sleeve 72 and includes a pressure head 74 rotatably supported from one end thereof and a transverse handle 76 on its other end to facilitate manual turning of the clamp screw 30.

In operation, one of the attachment 22 may have its clamp assembly 24 slidingly engaged over one end of one of the side rails of the ladder 10 and, if desired, the clamp assembly 24 of a second attachment 22 may be slidingly engaged over the other side rail of the ladder 10. Then, the clamp assemblies 24 may be shifted longitudinally of the side rails to the desired positions thereof and releasably retained in adjusted position by tightening the clamp screws 48. When the ladder 10 is leaned against the lower marginal portion 18 of the roof structure 20 in the manner illustrated in FIG. 1 of the drawings, the attachment 22 may be slid upwardly along the corresponding side rail of the ladder 10 and secured in position by tightening the clamp screw 48. With the attachment 22 adjusted in position as illustrated in FIG. 1 of the drawings and the arm 26 supporting the mount 28 and the clamp screw 30 beneath the closed eave 21, the clamp screw 30 may be threaded through the sleeve 72 in orderto engage the underside of the closed eave 21 and thus clamp the ladder 10 to the lower marginal portion 18 of the roof structure 20 against accidental shifting relative thereto.

Figure 3:
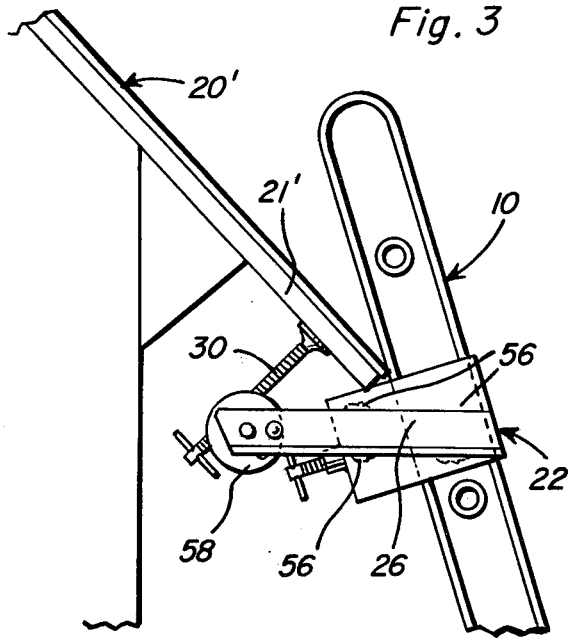
FIG. 3 is a fragmentary, side elevational view similar to FIG. 1 but illustrating the ladder and clamp operatively associated with a different type of building roof marginal portion.
Figure 2:
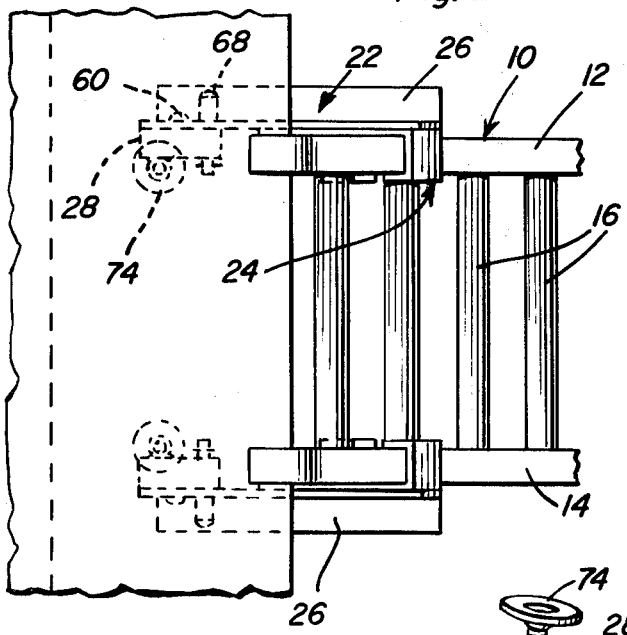
FIG. 2 is a fragmentary, top plan view of the assemblage illustrated in FIG. 1.
Figure 5:
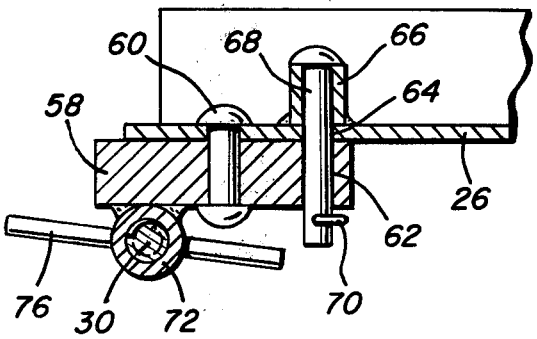
FIG. 5 is a fragmentary, enlarged, sectional view taken substantially upon the plane indicated by the section line 5—5 of FIG. 4.
Figure 4:
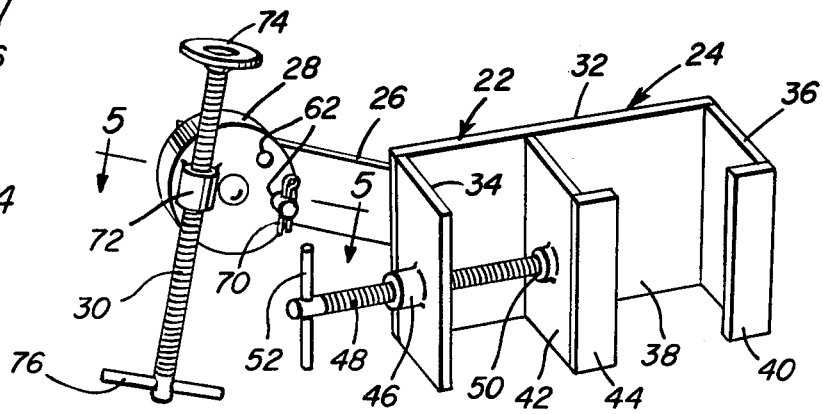
FIG. 4 is a perspective view of the attachment.

However, if the ladder 10 is to be leaned against a roof structure, such as that generally referred to by the reference numeral 20' in FIG. 3, and including an open eave 21', the pin or fastener 68 is removed and the mount 28 is rotated to the second position thereof and secured therein by reinsertion of the pin 68. In this position of angular displacement of the mount 28, the clamp screw 30 is inclined approximately 45 degrees relative to the support arm and the clamp screw 30 is thereby threadedly adjustable upwardly through the sleeve 72 to clampingly engage and be disposed at substantially right angles to the underside of the open eave 21'.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A bracket for a ladder, said bracket including mounting means for support from a ladder at a predetermined point spaced therealong, an elongated support arm having one end supported from said mounting means with the other end of said support arm projecting outwardly from said mounting means in a direction therefrom to be oriented at generally right angles relative to a plane containing the associated ladder when said bracket is supported therefrom, an angularly displaceable mount supported on said other end of said support arm for oscillation about an axis transverse to said arm, and an elongated clamp arm supported from said mount for oscillation therewith relative to said support arm, said clamp arm being disposed at generally right angles relative to said axis and swingable with said mount, during its oscillation relative to said support arm, in a plane generally paralleling said support arm, said clamp arm including one end portion thereof supported, relative to said mount, for lengthwise advancement and retraction of said one end portion of said clamp relative to said mount.

2. The combination of claim 1 wherein said mounting means includes means for slidably engaging the side rail of an associated ladder for adjustment of said mounting means longitudinally along said side rail.

3. The combination of claim 2 wherein said mounting means also includes clamp means for releasably clampingly engaging the associated side rail and thereby releasably retaining said bracket in adjusted shifted position along said side rail.

4. The combination of claim 1 wherein said mounting means includes a clamp member for slidingly and releasably clampingly engaging the corresponding ladder side rail.

5. The combination of claim 1 wherein said mount and support arm include coacting means for releasably retaining said mount in selected predetermined angularly displaced positions.

6. The combination of claim 5 wherein said predetermined angularly displaced positions include a first position with said clamp arm extending in a direction disposed at generally right angles relative to said support arm and a second position with said one end portion inclined generally 45 degrees relative to said support arm and inclined toward said one end of said support arm.

7. In combination with an upstanding ladder including a first side adapted to oppose an adjacent structure from which the upper end of said ladder is to be supported, a support arm carried by said ladder and projecting generally horizontally outwardly of said one side of said ladder, a mount carried by the outer end of said arm and angularly displaceable relative thereto about an axis extending transversely of said support arm, an elongated clamp arm supported from said mount for oscillation therewith relative to said support arm, said clamp arm being disposed at generally right angles to said axis and swingable with said mount, during its oscillation relative to said support arm, in a plane generally paralleling said support arm, said clamp arm including one end portion thereof supported, relative to said mount, for lengthwise advancement and retraction of said one end portion relative to said mount.

8. The combination of claim 7 wherein said mount and support arm include coacting means for releasably retaining said mount in selected predetermined angularly displaced positions.

9. The combination of claim 8 wherein said predetermined angularly displaced positions include a first position with said clamp arm extending in a direction disposed at generally right angles relative to said support arm and a second position with said one end portion inclined generally 45 degrees relative to said support arm and inclined toward said one end of said support arm.

10. The combination of claim 9 including a mounting means carried by the end of said support arm remote from said mount stationarily supported from said ladder.

11. The combination of claim 10 wherein said mounting means includes clamp means slidingly engaged with one of the side rails of said ladder for adjustable positioning therealong and releasably clampingly engaged with said side rail retaining said clamp means in adjusted position therealong.

* * * * *